US011376885B2

(12) United States Patent
Michenaud

(10) Patent No.: US 11,376,885 B2
(45) Date of Patent: Jul. 5, 2022

(54) MULTIFUNCTION WRITING INSTRUMENT

(71) Applicant: SOCIETE BIC, Clichy (FR)

(72) Inventor: Etienne Michenaud, Montrouge (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 17/048,481

(22) PCT Filed: Apr. 18, 2019

(86) PCT No.: PCT/EP2019/060185
§ 371 (c)(1),
(2) Date: Oct. 16, 2020

(87) PCT Pub. No.: WO2019/202120
PCT Pub. Date: Oct. 24, 2019

(65) Prior Publication Data

US 2021/0078355 A1 Mar. 18, 2021

(30) Foreign Application Priority Data

Apr. 19, 2018 (FR) ..... 1853468

(51) Int. Cl.
*B43K 24/14* (2006.01)
*B43K 24/18* (2006.01)
*B43K 27/02* (2006.01)

(52) U.S. Cl.
CPC ..... *B43K 24/146* (2013.01); *B43K 24/186* (2013.01); *B43K 27/02* (2013.01); *B43K 24/14* (2013.01)

(58) Field of Classification Search
CPC .... B43K 24/146; B43K 24/286; B43K 27/02; B43K 24/00; B43K 24/10; B43K 24/14;
(Continued)

(56) References Cited

U.S. PATENT DOCUMENTS 4,221,491 A 9/1980 Ganz
4,283,151 A 8/1981 Sekiguchi
7,008,131 B2 * 3/2006 Kagevarna ..... B43K 24/146 401/30

FOREIGN PATENT DOCUMENTS

DE 801762 C 1/1951
EP 0369995 A2 5/1990

OTHER PUBLICATIONS

International Search Report issued in International Application PCT/EP2019/060185 dated Jun. 21, 2019, (13 pages).

* cited by examiner

*Primary Examiner* — David J Walczak
(74) *Attorney, Agent, or Firm* — Bookoff McAndrews, PLLC

(57) ABSTRACT

A multifunction writing instrument comprising a body extending along an axial direction and housing at least two writing elements, each writing element comprising a writing tip, a selector device configured to select one writing element from among the at least two writing elements, a retraction device configured to move a selected writing element between a writing position in which the writing tip of the selected writing element projects from the body and a retracted position in which the writing tip of the selected writing element is retracted, and a return device configured to bring a writing element from the writing position to the retracted position when the selector device is activated while a writing element is in the writing position.

18 Claims, 10 Drawing Sheets

(58) Field of Classification Search
CPC ..... B43K 24/12; B43K 24/143; B43K 24/16; B43K 24/18
USPC ..... 401/29–33
See application file for complete search history.

MULTIFUNCTION WRITING INSTRUMENT

CROSS REFERENCE TO RELATED APPLICATION(S)

This application is a National Stage Application of International Application No. PCT/EP2019/060185, filed on Apr. 18, 2019, now published as WO2019/202120 and which claims priority to French Application No. FR1853468, filed on Apr. 19, 2018.

TECHNICAL FIELD

The present disclosure relates to a multifunction writing instrument. It should be recalled that a multifunction writing instrument is a writing instrument having a plurality of writing elements, each writing element being usable selectively.

BACKGROUND

Known multifunction writing instruments are not always very easy to manipulate when it is desired to use a writing tip that is different from the tip that is being used. There therefore exists a need in this sense.

SUMMARY

An embodiment provides a multifunction writing instrument comprising a body extending along an axial direction and housing two or more writing elements, each writing element including a writing tip, a selector device configured to select one writing element from among the two or more writing elements, a retraction device configured to move a selected writing element between a writing position in which the writing tip of the selected writing element projects from the body and a retracted position in which the writing tip of the selected writing element is retracted, and a return device configured to bring one of the writing elements from the writing position back to the retracted position when the selector device is activated while another of the writing elements is in the writing position.

In general manner, it can be understood that the writing instrument extends in an axial direction that corresponds to the direction of the axis of the body (i.e. the axial direction of the body). A radial direction is a direction perpendicular to the axis of the body, and a circumferential or azimuth direction corresponds to a direction describing a ring around the axial direction. Finally, unless specified to the contrary, the adjectives "inside" and "outside" or "inner" and "outer" are used with reference to a radial direction such that an inner element (i.e. a radially inner element) is closer to the axis of the body than is an outer element (i.e. a radially outer element).

Below, and unless specified to the contrary, the term "writing instrument" is used to mean "multifunction writing instrument".

Naturally, the writing instrument may present two or more writing elements. Below, and unless specified to the contrary, the term "the writing elements" means "the at least two writing elements".

In the meaning of the present disclosure, a writing element is formed by any element that has a writing tip. By way of example, the writing tip may be a felt tip, a ball or other point, a graphite lead, a mechanical pencil lead, a chalk, any other means suitable for writing on a substrate, or an (active or passive) endpiece configured to co-operate with a touch screen, e.g. a capacitive, resistive, inductive, infrared, optical, electrostatic, etc. screen. For example, if the writing element comprises a ballpoint, it also comprises an ink reservoir. In another example, if the writing element comprises a mechanical pencil, it also comprises a lead propelling mechanism and a lead reservoir. Below, and unless specified to the contrary, it is assumed that the writing tip of any writing element is carried by a writing head, the writing tip possibly being stationary (e.g. a ballpoint) or movable (e.g. a mechanical pencil lead) relative to the writing head.

The body is naturally hollow and configured to receive the writing elements. The body thus presents an inside and an outside.

It can be understood that the selector device serves to select a writing element, while the retraction device serves to actuate the writing element. Thus, in the meaning of the present disclosure, the term "select a writing element" is used to mean "configure the writing instrument so that the writing element can co-operate with the retraction device" in satisfactory manner. Naturally, it should be understood that the selector device serves to select no more than one writing element at a time. For example, in intermediate positions, the selector device co-operates with a plurality of writing elements, whereas the selector device co-operates with only one writing element when a writing element is selected. In a first a variant, when a writing element is selected by means of the selector device, the head of the writing element may remain retracted within the body, in which case the retraction device can be used to cause the writing head to move into and out from the body. This first variant is appropriate both for writing elements having a fixed writing tip and for writing elements having a movable writing tip. In a second variant, that is particularly appropriate for writing elements having a movable writing tip, when a writing element is selected by means of the selector device, the head of the writing element extends out from the body, in which case the retraction device serves solely to cause the writing tip to move into and out from the writing head. Naturally, within the writing instrument, one writing element may be configured as the first variant while another writing element may be configured as the second variant. In other words, the first and second variants can coexist within a single writing instrument.

It can be understood that the retraction device serves to move the writing tip of the selected writing element between a writing position and a retracted position. For example, when the writing element has a fixed writing tip, e.g. such as a ballpoint mounted on a head, itself mounted on an ink reservoir, when in the retracted position the writing tip is inside the body, whereas in the writing position the writing tip extends outside the body. In another example, when the writing tip of the writing element is movable, e.g. such as a lead carried by a head of a mechanical pencil mechanism, then in the retracted position the lead may be inside the mechanical pencil, it being possible for the head of the mechanical pencil either to be inside the body or else to extend outside the body, or else the lead may extend outside the head of the mechanical pencil while the head is inside the body, so that the lead does not project from the body. Naturally, in the writing position, such a movable writing tip extends outside the body, the head of the writing element possibly being outside or inside the body. In other words, for writing elements having a movable writing tip, the retraction device may serve solely to cause the writing tip to move into and/or out from the head of the writing element (e.g. in order to propel the lead of a mechanical pencil, and allow it to return into the mechanical pencil when the jaws of the pencil mechanism are un-clamped).

Thus, the user firstly selects the writing element that is to be used by means of the selector device, and secondly moves the writing tip between a retracted position and a writing position by means of the retraction device.

The return device serves to bring a writing element from the writing position back to the retracted position when it is desired to select a writing element other than the writing element in the writing position. Thus, by actuating the selector device, the return device is actuated. In other words, the return device is coupled with the selector device, at least while a writing element is in the writing position. This makes manipulating the writing instrument particularly easy for the user. Specifically, the user can select a writing element without worrying about the position of the already-selected writing element. Furthermore, in some variants, the selector device can be actuated only if all of the writing elements are in the retracted position, otherwise there is a risk of bringing the various mechanisms of the retraction device and/or of the selector device out of alignment, or indeed of blocking or damaging these mechanisms. For these variants of the writing instrument, the return device thus also serves to avoid any blocking, damage, and/or loss of alignment of the mechanisms of the selector device and of the retraction device.

In some embodiments, the body comprises a front portion and a rear portion, the front portion and the rear portion being rotatably movable relative to each other about the axial direction, the selector device comprising a cam rotatably coupled with the rear portion and configured to co-operate with the writing elements while the writing elements are rotatably coupled with the front portion, the retraction device comprising a ratchet mechanism comprising a rotary cam and a plunger cam, the plunger cam being rotatably coupled with the rear portion, the rotary cam being rotatably coupled with the front portion when a writing element is in the writing position, while the rotary cam is free to turn relative to the front portion when all of the writing elements are in the retracted position, whereby the rotary cam turns so as to release the plunger cam in the axial direction relative to the rotary cam when the selector device is activated while a writing element is in the writing position.

It can be understood that the front portion is turnable relative to the rear portion (and vice versa) about the axial direction (i.e. in the circumferential direction).

While the front portion is turning relative to the rear portion, the cam of the selector device is caused to turn relative to the front portion by the rear portion, and depending on its azimuth position relative to the writing elements, the cam co-operates with no, or with one or another or several of the writing elements.

The plunger cam is rotatably coupled with the rear portion, and this applies regardless of the configuration of the writing instrument. The rotary cam is rotatably coupled with the front portion only when a writing element is in the writing position. Thus, when it is desired to actuate the selector device by turning the front portion relative to the rear portion (or vice versa), and if a writing element is in the writing position, then the rotary cam, which is rotatably coupled with the front portion, also turns relative to the rear portion. Since the plunger piston is rotatably coupled with the rear portion, the rotary cam turns relative to the plunger piston, thereby having the effect of releasing the plunger cam from the rotary cam (and vice versa) and allowing the writing element to return into the retracted position. Such a structure contributes to making the writing instrument easy to use.

In some embodiments, the front portion presents an axially extending rod, the rod including at least one axial groove or at least one axial rib, the rotary cam being engaged around the rod and presenting respectively at least one axial rib or at least one axial groove, the axial rib and the axial groove being engaged with each other when a writing element is in the writing position, and being disengaged from each other when all of the writing elements are in the retracted position.

Such an axial rib/groove system is simple and compact, and enables the front portion and the rotary cam to be coupled/uncoupled for turning together in a manner that is reliable, efficient, and easy to use.

In some embodiments, the cam of the selector device and the plunger cam of the ratchet mechanism are formed by a single part.

Such a configuration is compact and enables the number of different parts within the writing instrument to be reduced. This simplifies the overall structure of the writing instrument, facilitates assembling it, and serves to increase its reliability, thereby contributing indirectly to making the writing instrument easy for the user to manipulate.

In some embodiments, the plunger cam includes an annular portion, the rotary cam being arranged radially inside the annular portion.

Such a configuration is compact and saves space, thereby enabling writing elements of greater capacity to be received within the writing instrument.

In some embodiments, the rotary cam is prevented from moving in the axial direction relative to the front portion when all of the writing elements are in the retracted position, while the rotary cam is movable along the axial direction relative to the front portion when a writing element is in the writing position.

For example, depending on whether one writing element is in the writing position or all of the writing elements are in the retracted position, the space between two axial shoulders (i.e. transversely to the axial direction) in which the rotary cam is located is of greater or smaller size, thereby authorizing or blocking axial movement of the rotary cam.

The rotary cam being blocked axially when all of the writing elements are in the retracted position enables rotation of the rotary cam to be guided better while actuating the retraction device in order to bring a writing element into the writing position. Conversely, when a writing element is in the writing position, the fact that the rotary cam is axially movable enables it to become disengaged from the front portion during turning of the front portion relative to the rear portion, e.g. by decoupling a system of teeth or of grooves and ribs. Thus, the rotary cam is rotatably coupled with the front portion over only a fraction of the total rotary stroke of the front portion relative to the rear portion. This makes it possible to sequence the actuation of the various devices, i.e. to begin by actuating the return device in order to release the rotary cam from the plunger cam and allow the writing element in the writing position to return towards the retracted position, and subsequently to continue solely with the action on the selector device in order to select another writing element. Such a configuration is particularly well adapted to variants in which the selector device can be actuated only when all of the writing elements are in the retracted position.

In some embodiments, the rotary cam is rotatably coupled with the plunger cam when all of the writing elements are in the retracted position.

For example, the coupling may be obtained by engaging teeth of the plunger cam with teeth of the rotary cam. Such coupling makes it possible, while actuating the selector device, to conserve proper alignment of the elements of the mechanism of the retraction device. Thus, when the front portion is turned relative to the rear portion in order to select a writing element, it is certain that the alignment of the two cams of the retraction device will be conserved, whereby the retraction device is perfectly operational regardless of the position of the selector device, in particular regardless of which writing element is selected. This makes the writing instrument more reliable and contributes to making it easy to manipulate.

In some embodiments, the cam of the selector device is configured to co-operate with cam followers of the writing elements, each cam follower being received to slide axially in an axial guide of the front portion.

It can thus be understood that the writing elements can slide axially within an axial guide, and thus within the front portion. Each guide serves to keep the writing element that it receives in position relative to the front portion, both in the radial direction and in the circumferential direction. This facilitates interaction between the cam of the selector device and the writing elements, making the writing element gentler and easier to use.

In some embodiments, at least one writing element is a mechanical pencil, the retraction device being usable to propel the lead of the mechanical pencil when the mechanical pencil is in the writing position.

Specifically, the writing instrument of the present disclosure is particularly well adapted to mechanical pencils.

In some embodiments, the mechanical pencil presents a writing head that is configured to carry the lead, the lead forming a writing tip, the writing head projecting from the body when the mechanical pencil is selected by means of the selector device.

It can thus be understood that the writing head projects from the body as soon as the mechanical pencil has been selected. As described above, in such a configuration, the retraction device serves only to propel the lead, which in the meaning of the present disclosure is considered as moving the writing tip, from a retracted position to a writing position. A writing device including such a mechanical pencil is particularly easy to use.

Naturally, in a variant, the set of writing elements (i.e. including a mechanical pencil as defined above) may include a mechanical pencil that presents a writing head configured to carry the lead, the lead forming a writing tip, the mechanical pencil being such that when it is selected by means of the selector device, it is movable between an extended position in which the writing head projects from the body and a retracted position in which the writing head is brought into the body by the retraction device, and when it is in the extended position, the retraction device serves to enable the lead to be propelled by being moved only partially compared with the movement needed by the retraction device in order to cause the mechanical pencil to pass from the extended position to the retracted position.

It can thus be understood that in this variant, the head does not project from the body when the mechanical pencil is selected (i.e. it is in the retracted position). It is then necessary to actuate the retraction device in order to move the head out from the body. Once the head is located outside the body (i.e. in the extended position), actuating the retraction device only partially serves to propel the lead, whereas actuating the retraction device fully serves to cause the head to return back inside the body, i.e. into the retracted position. A writing device having such a mechanical pencil enables the head of the mechanical pencil to be located inside the body when it is selected, thereby serving to protect it.

BRIEF DESCRIPTION OF THE DRAWINGS

The subject matter of the present disclosure and its advantages can be understood better on reading the following detailed description of various embodiments that are given as non-limiting examples. The description refers to the accompanying sheets and figures, in which.

DETAILED DESCRIPTION

Figure 1:
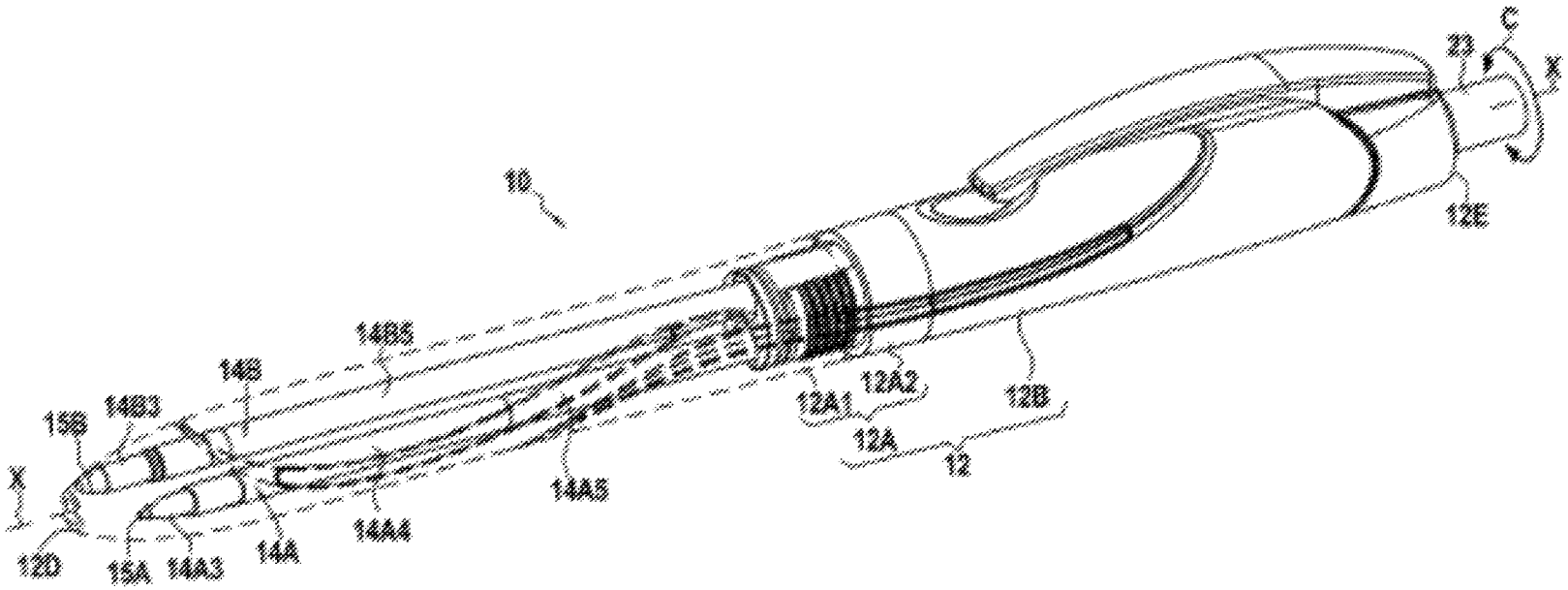
FIG. 1 shows an embodiment of a writing instrument seen in perspective.

FIG. 1 shows a multifunction writing instrument 10 extending along an axial direction X and comprising a body 12 that, in this example, houses two writing elements 14A and 14B, namely a mechanical pencil and a ballpoint element. Naturally, in a variant, the writing instrument could have more than two writing elements. In another variant, both writing elements could be identical, or indeed could be of kinds other than a mechanical pencil or a ballpoint element. In this example, the mechanical pencil 14A comprises a writing head 14A3, a lead-propelling mechanism 14A4, and a lead reservoir 14A5. A lead (or writing tip) 15A is carried by the head 14A3. The writing element 14B has a writing head 14B3 comprising a ballpoint (or writing point) 15B, and an ink reservoir 14B5.

In this example, the body 12 comprises a front portion 12A, and a rear portion 12B. The front portion 12A comprises a first portion 12A1 and a second portion 12A2, the second portion 12A2 forming an intermediate portion between the first portion 12A1 and the rear portion 12B. The first portion 12A1 and the rear portion 12B are mounted respectively on the second portion 12A2 so as to be turnable relative to each other about the axial direction X (i.e. movable in the circumferential direction C). In this example, the first portion 12A1 and the second portion 12A2 are coupled together in rotation (e.g. being assembled together by screw-fastening tightened to a certain torque, or else by clipping with a coupling lug), while the rear portion 12B is turnable about the axial direction X relative to the second portion 12A2 (e.g. by axial clip-fastening using annular portions in relief, permitting turning about the axial direction X). The front and rear portions 12A and 12B are thus turnable relative to each other about the axial direction X. In FIG. 1, the first portion 12A1 is drawn transparently, so that the writing elements can be seen. Naturally, the various elements of the body 12, and in particular the first portion 12A1, may be transparent or opaque, so as to enable the user to see the inside of the writing instrument 10, or so as to prevent the user from seeing the inside. The writing elements 14A and 14B are carried by the second portion 12A2. The second portion 12A2 is rotatably coupled about the axial direction X with the first portion 12A1, and the writing elements 14A and 14B are rotatably coupled with the entire front portion 12A.

Figure 2:
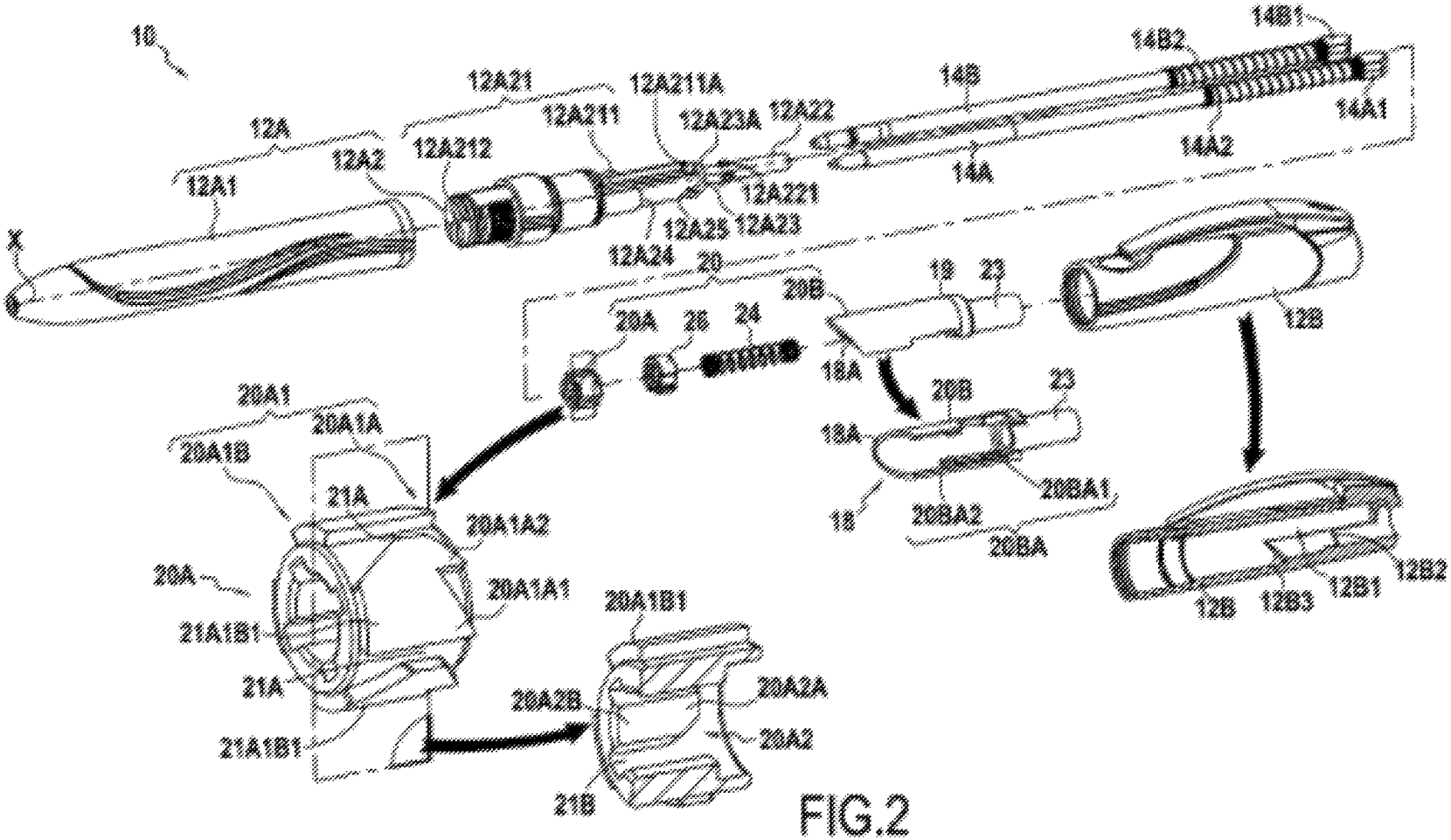
FIG. 2 shows the FIG. 1 writing instrument in an exploded view.

The writing instrument 10 is described below in greater detail with reference to FIG. 2. The writing instrument 10 comprises a selector device 18, a retraction device 20, and a return device 22 (see also FIG. 6A).

The selector device 18 comprises a cam 18A configured to co-operate in abutment with the writing elements 14A and 14B, and more particularly in this example with cam followers 14A1 and 14B1 of the elements 14A and 14B. The cam 18A is received in a slideway 12B1 of the rear portion 12B enabling the cam 18A to slide along the axial direction X relative to the rear portion 12B and to be rotatably coupled about the axial direction X with the rear portion 12B. Furthermore, in this example, the rear portion 12B presents an inside shoulder 12B3 (which is naturally coupled to the rear body 12B) that extends the profile of the cam 18A when the retraction device 20 is in a configuration corresponding to the retracted position of the writing elements. Thus, by means of the cam 18A and the shoulder 12B3, the selector device 18 presents a closed cam profile of oval shape, the plane of the oval sloping relative to the axial direction X. In this example, the cam 18A extends over an angular amplitude of more than 180° (one hundred eighty degrees of angle) and can co-operate simultaneously with both writing elements when changing the writing element that is selected. In other words, in this example, the writing elements 14A and 14B are arranged at 180° relative to each other (i.e. they are diametrically opposite within the writing instrument 10), and when it is desired to select a writing element other than the already-selected writing element, the cam 18A occupies intermediate positions in which it co-operates simultaneously with both writing elements 14A and 14B. Nevertheless, when a writing element is selected, the cam 18A co-operates with that writing element only, and not with the other.

The rear portion 12B presents an inside shoulder 12B2 (which is naturally coupled to the rear portion 12B) that is set back rearwards relative to the writing instrument (i.e. towards the end 12E of the body 12 as shown in FIG. 1), which shoulder does not co-operate with the writing elements 14A and 14B, but only with a washer 26 in the writing position.

By means of the cam profile formed by the cam 18A of the selector device 18, the rear portion 12B can turn through 360° (three hundred sixty degrees of angle) relative to the front portion 12A about the axial direction X, in one direction or the other, selecting in succession the writing element 14A and the writing element 14B. In a variant, the relative rotary stroke between the front portion 12A and the rear portion 12B could be less than 360°, in which case it is necessary to turn in one direction to select one writing element and in the opposite direction to select the other writing element.

While the front portion 12A is turning relative to the rear portion 12B (or vice versa) in order to select a writing element, the cam 18A co-operates with the cam followers 14A1 and 14B1 by bearing against them in the circumferential and axial directions C and X. In order to ensure that the writing elements 14A and 14B remain in position within the second portion 12A2 of the front portion 12A, the second portion 12A2 has two guides 12A21, in this example axial grooves 12A211 leading to axial through holes 12A212. The cam followers 14A1 and 14B1 are slidably received within the grooves 12A211, while the remaining portions of the writing elements 14A and 14B extend in and on either side of the holes 12A212. Compression springs 14A2, 14B2 are arranged respectively between the cam followers 14A1, 14B1 and the second portion 12A2, within the grooves 12A211. These springs are useful in particular when using the retraction device 20 as described below. It should be observed that the grooves 12A211 are closed in the axial direction X at their rear ends, remote in the axial direction from the holes 12A212, by means of respective shoulders 12A211A limiting the rearward axial stroke of the writing elements 14A and 14B. Each shoulder 12A211A thus blocks the stroke of a writing embodiment 14A or 14B when the cam 18A is not co-operating with the writing elements. The shoulder 12A211A of each guide is of a shape that is complementary to the cam followers 14A1 and 14B1, and it co-operates with the cam followers 14A1 and 14B1 as a result of being complementary in shape.

The writing elements 14A and 14B are thus held and guided along the axial direction by the guides 12A21, in particular when the cam 18A is engaged with them. When the cam 18A co-operates with a writing element, the writing element is pushed towards the front of the writing device (i.e. towards the end 12D of the body 12 in FIG. 1). This corresponds to the position of the writing element 14A in FIG. 3B. When the cam 18A does not co-operate with a writing element, the writing element is pushed towards the rear of the writing device (i.e. towards the rear end 12E of the body 12 in FIG. 1) by its spring, so that the cam follower co-operates in abutment against the shoulder 12A211A of the guides 12A21. This corresponds to the position of the writing element 14B in FIG. 3B. In an intermediate position, the cam 18A co-operates with both cam followers 14A1 and 14B1. This corresponds to the position shown in FIG. 3A.

In this example, it should be observed that the rear portion 12B may be separated from the second portion 12A2 of the front portion 12A to enable the writing elements 14A, 14B to be removed. Specifically, the front portions of the writing elements 14A and 14B extending in the first portion 12A1 of the front portion 12A can slide freely within the holes 12A212, so the writing elements can be removed in order to be replaced. In a variant, the second portion 12A2 comprises two distinct parts, namely a first part forming the holes 12A212 and a second part forming the grooves 12A211. The first part is mounted to turn with the first portion 12A1 (i.e. free to rotate about the axial direction X, but coupled in translation), e.g. by means of a clip-fastening. The second part is mounted to turn with the rear portion 12B (i.e. they are free to turn about the axial direction X, but coupled in translation), e.g. by means of clip-fastening. The first portion 12A1 is mounted on the second part by screw-fastening, the first part and the second part being rotatably coupled together about the axial direction X. By unscrewing the first portion 12A1 from the second part, the first part is removed simultaneously, thereby enabling the writing elements to be removed directly from the grooves that are opened axially in this way. This variant makes it easy to replace the writing elements.

The retraction device 20 is a ratchet mechanism comprising a rotary cam 20A and a plunger cam 20B. The plunger cam 20B is integral with the cam 18A of the selector device 18. The plunger cam 20B is moved in translation about the axial direction X by a button 23 arranged at the rear end 12E of the body 12. In this example, the button 23, the plunger cam 20B, and the cam 18A of the selector device 18 together form a single part 19.

The ratchet mechanism 20 co-operates with the writing elements 14A and 14B via the cam 18A of the selector device 18, thereby enabling each of the writing elements to be moved between a retracted position and a writing position. When the cam 18A is engaged with a writing element, the spring 14A2 or 14B2 of the writing element compresses the ratchet mechanism 20, thereby enabling it to be used.

The rotary cam 20A is generally in the shape of a ring having its axis coinciding with the axial direction X and capable of turning about the axial direction X. On its outside surface, this ring carries a first series of teeth 20A1 configured to co-operate with the plunger cam 20B, and on its inside surface it carries a second series of teeth 20A2 configured to co-operate with the front portion 12A of the body 12, and more particularly in this example with the second portion 12A2.

The first series of teeth 20A1 comprises rear teeth 20A1A and front teeth 20A1B. The rear teeth 20A1A are of triangular sawtooth shape with one side parallel to the axial direction X and another side that slopes relative to the axial direction, and they form a series comprising in succession in the circumferential direction both a tooth 20A1A1 that is long in circumferential direction and also a tooth 20A1A2 that is short in the circumferential direction. The sloping faces of the long teeth 20A1A1 and of the short teeth 20A1A2 face towards the same side. The rear teeth 20A1A1 and 20A1A2 in each pair are spaced apart circumferentially by an axial passage 21A. The face parallel to the axial direction of the long tooth 20A1A1 and the face sloping relative to the axial direction of the short tooth 20A1A2 face towards the passage 21A. In this example, there are four pairs of rear teeth 20A1A1 and 20A1A2 that are regularly distributed in the circumferential direction, with a passage 21A being formed between each adjacent pair of teeth. The front teeth 20A1B are of trapezoidal shape and they are all similar, being regularly distributed circumferentially and spaced apart by passages 21A. Each tooth 20A1B presents a face parallel to the axial direction X and lying axially in line with the face of a long tooth 20A1A1 that is parallel to the axial direction. Each tooth 20A1B presents a face that is perpendicular relative to the axial direction and that forms an axial shoulder. Finally, each tooth 20A1B presents a face that slopes relative to the axial direction, facing a passage 21A. The sloping face of each tooth 20A1B is arranged on the same side as the sloping face of a short tooth 20A1A2. In other words, the sloping faces of the teeth 20A1B and the teeth 20A1A2 face a passage 21A in the same circumferential direction. In this example, there are four teeth 20A1B. In this example, a single radial projection forms a tooth 20A1A1, a tooth 20A1A2, and a tooth 20A1B. In other words, the outside face of the rotary cam 20A has four radial projections forming the first series of teeth 20A1.

The second series of teeth 20A2 comprises rear teeth 20A2A and front teeth 20A2B. The rear teeth 20A2A are trapezoidal in shape and they are spaced apart by axial passages 21B, while the front teeth 20A2B are square in shape and they are spaced apart by the same axial passages 21B. Each rear tooth 20A2A presents a face parallel to the axial direction X, a face perpendicular to the axial direction X and forming an axial shoulder, and a face sloping relative to the axial direction and facing a passage 21B. The slope of the inclined face of each tooth 20A2A1 slopes on the same side as the slope of the teeth 20A1A1 and 20A1A2. Each front tooth 20A2B presents two faces parallel to the axial direction X and one face perpendicular to the axial direction X, forming an axial shoulder. In this example, there are four rear teeth 20A2A and four front teeth 20A2B. In this example, a single radial projection forms one rear tooth 20A2A and one front tooth 20A2B. In other words, the inside face of the rotary cam 20A has four radial projections forming the second series of teeth 20A2.

The rotary cam 20B is engaged on an axial rod 12A22 of the second portion 12A2 of the front portion 12A of the body 12. This rod 12A22 has teeth 12A221, and in this example it has four teeth 12A221 that are uniformly distributed and spaced apart around the circumferential direction on the rod 12A22. These teeth 12A221 are in the form of axial ribs. These teeth 12A221 are configured to co-operate with the second series of teeth 20A2 of the rotary cam 20A and they can engage in and slide along the passages 21B, which are in the form of axial grooves. This system of teeth 12A221 and 20A2 forms the return system 22 (see also FIG. 6A).

It should be observed that the rod 12A22 extends from a base 12A23 that forms a shoulder limiting axial movement towards the front of the rotary cam 20A. Since the rotary cam 20A can turn about the rod 12A22 (when it is not engaged with the teeth 12A221), the base 12A23 is provided with four distinct studs 12A23A that are regularly distributed around the circumferential direction in order to limit friction between the base 12A23 and the rotary cam 20A.

The plunger cam 20B is in the form of an annular portion of axis that extends along the axial direction X and that receives the rotary cam 20A. In other words, the rotary cam 20A is arranged radially inside the plunger cam 20B.

The plunger cam 20B presents two pairs of teeth 20BA that are diametrically opposite. Each pair of teeth 20BA presents a rear tooth 20BA1 and a front tooth 20BA2. Each tooth is in the form of an axial rib, the rear and front teeth 20B1 and 20B2 of a given pair 20BA being offset from each other in the axial direction X and in the circumferential direction C. Each pair of teeth 20BA is configured to co-operate with the first series of teeth 20A1 of the rotary cam 20A. In particular, the front teeth 20BA2 co-operate with the front teeth 20A1B and can engage in and slide along the passages 21A, while the rear teeth 20BA1 co-operate with the rear teeth 20A1A.

The single part 19 forming the cam 18A of the selector device, the plunger cam 20B, and the button 23 is engaged on the rod 12A22. A spring 24 and the washer 26 are also engaged on the rod 12A22 between the part 19 and the rotary cam 20A. The button 23 is hollow and receives the rear end of the spring 24. The front end of the spring 24 co-operates axially with the rotary cam 20A via the washer 26. The function of the washer 26 is to limit friction between the rotary cam 20A and the spring 24 when the rotary cam 20A turns. The washer 26 is free to move axially on the rod 12A22. The spring 24 and the washer 26 are arranged radially inside the plunger cam 20B. The function of the spring 24 is firstly to push the rotary cam 20A towards the front and secondly to form a return element tending to push the part 19 towards the rear.

The operation of the writing instrument 10 is described below with reference to FIGS. 3A to 6C.

Figure 3A:
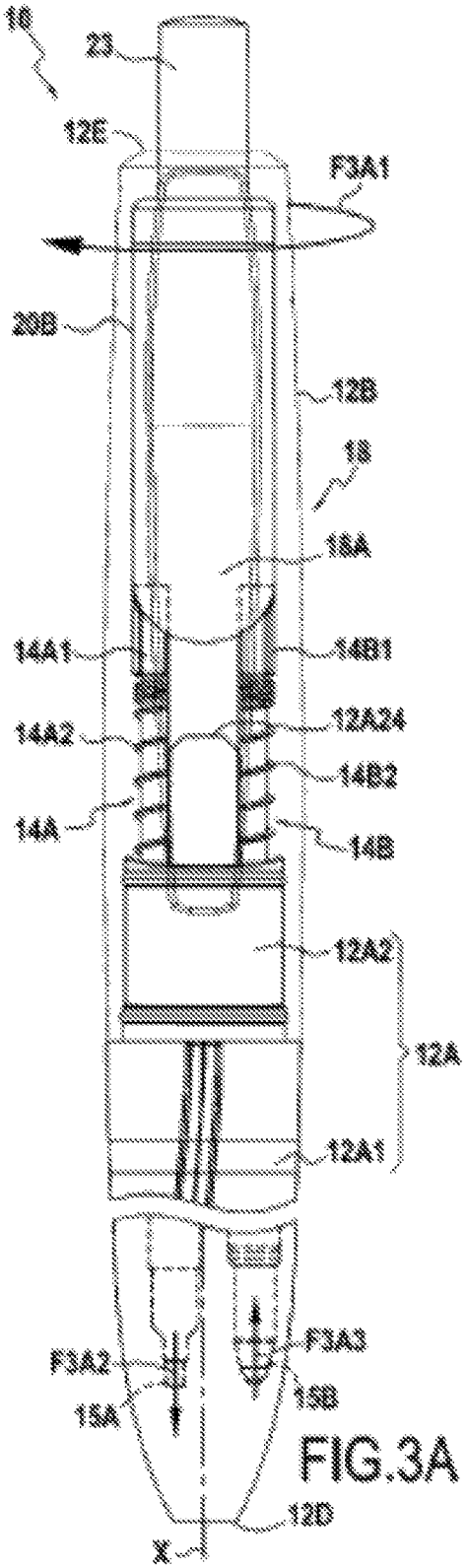
FIGS. 3A and 3B show the various steps for selecting a writing element.

In the state shown in FIG. 3A, no writing element is selected. The cam 18A of the cam device 18 co-operates with both cam followers 14A1 and 14B1. The cam followers 14A1 and 14B1 are thus remote from the shoulders 12A211A of their respective guides 12A21. It should be observed that in this position it is not possible to actuate the retraction device 20 since the axial stroke of the cam 18A, and thus of the plunger cam 20B, is limited by an abutment 12A24 of the front portion 12A, and more particularly of the second portion 12A2 of the body 12.

Figure 3B:
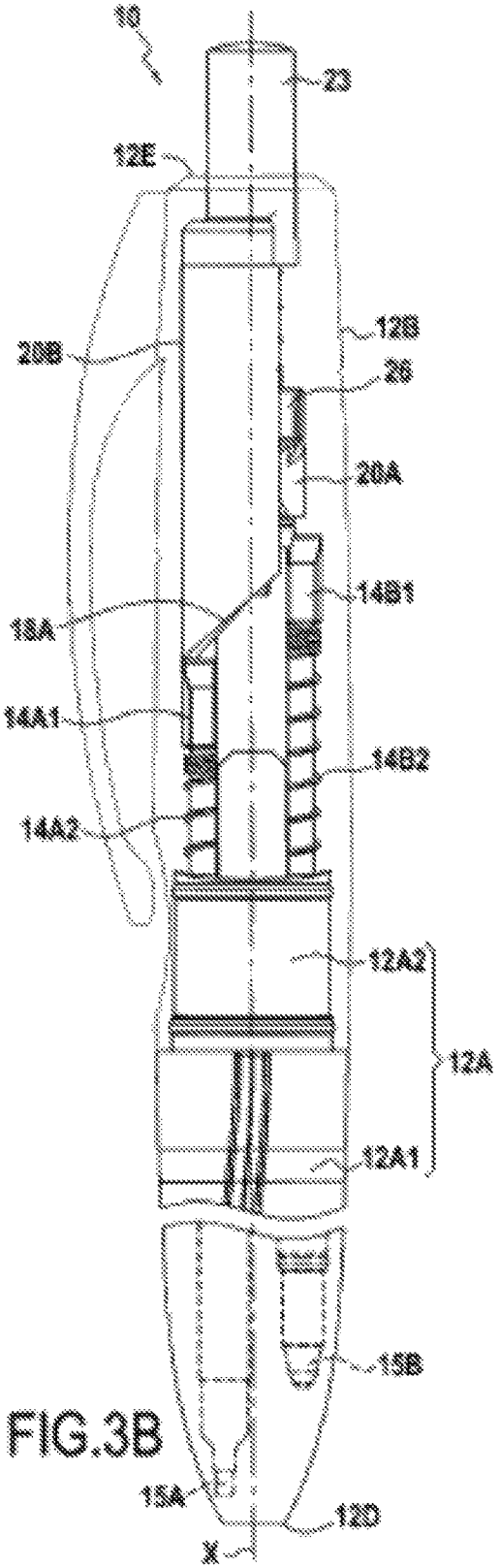

When it is desired to select a writing element, the front portion 12A is turned relative to the rear portion 12B of the body 12 (or vice versa) about the axial direction X, in one direction or the other. In FIG. 3A, the rear portion 12B is turned relative to the front portion 12A along arrow F3A1 so as to select the writing element 14A, and the cam 18A co-operates only with the cam follower 14A1. This causes the writing element 14A to move forwards along arrow F3A2 and the writing element 14B rearwards along arrow F3A3. FIG. 3B shows the final state after turning as shown in FIG. 3A, with the cam 18A engaged with the cam follower 14A1. It should be observed that compared with the state shown in FIG. 3A, the cam follower 14A1 is moved forwards by the cam 18A, while the cam 18A no longer co-operates with the cam follower 14B1 so that the cam follower 14B1 is moved rearwards by the spring 14B2 that is in abutment against the shoulder 12A211A.

It can be understood that in the state of FIG. 3B, the writing tip 15A of the writing element 14A is still retracted within the front portion 12A of the body 12, even though it has been moved forwards by the cam 18A while selecting the writing element 14A. In other words, the writing tip 15A is still in a retracted position. The same applies if it is the element 14B that is selected instead of the element 14A, with the tip 15B remaining retracted within the body 12 when the element 14B is selected by using the selector device 18.

With reference to FIGS. 4A to 4F, there follows a description of actuating the retraction device 20 (i.e. the ratchet mechanism 20) in order to move the writing tip 15A from the retracted position to the writing position. Naturally, in the description below, reference is made to only one tooth of each type, however the description applies to all of the teeth of the same type. It should be observed that in order to simplify the figures, only the general size of the part 19 is shown, and not its exact outline. Nevertheless, the positions of the cam 18A and of the teeth of the plunger cam 20B are naturally shown accurately.

Figure 4A:
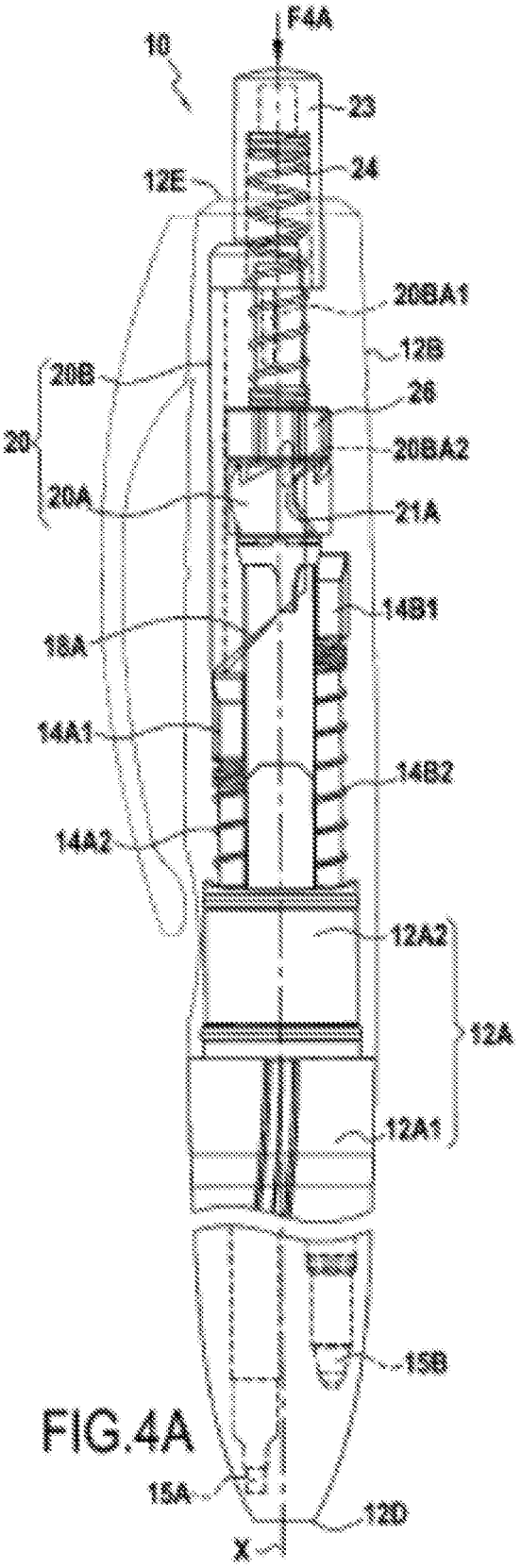
FIGS. 4A to 4F show the various steps for causing the writing element selected in FIG. 3B to pass from the retracted position to the writing position.

FIG. 4A corresponds to the position shown in FIG. 3B, in which the rotary cam 20A and one pair of teeth 20BA of the plunger cam 20B are shown. In this position, the front tooth 20BA2 of the plunger cam 20B is engaged in a passage 21A of the rotary cam 20A so that the rotary cam 20A is rotatably coupled with the plunger cam 20B, which is itself rotatably coupled with the cam 18A of the selector device 18. Thus, when selecting a writing element, as described above with reference to FIGS. 3A and 3B, the various elements of the ratchet mechanism 20 remain in alignment. Furthermore, the spring 24 pushes the rotary cam 20A axially against the base 12A23 via the washer 26. This ensures that the teeth 12A221 (not shown in FIG. 4A) of the front portion 12A do not run the risk of becoming engaged in the passages 21B of the rotary cam, thereby leaving the rotary cam 20B free to turn about the axial direction X. In other words, when all of the writing elements are in the retracted position, and regardless of the configuration of the selector device 18, the rotary cam 20A is free to turn relative to the front portion 12A about the axial direction X, but it is prevented from moving in translation relative to the front portion 12A along the axial direction X. Furthermore, in the event of a large jolt, any movement of the rotary cam 20A towards the rear is prevented by the teeth 20A2A co-operating axially in abutment against the teeth 12A211, except in the exceptional circumstance of the teeth 12A211 being in alignment with the passages 21B, in which case the spring 24 would cause the rotary cam 20A to return immediately against the base 12A23.

In order to actuate the ratchet mechanism 20, the button 23 is pressed forwards in the axial direction X, as represented by arrow F4A. This moves the plunger cam 20B axially. Since the plunger cam 20B is made integrally with the cam 18A of the selector device 18, this also moves the cam 18A axially, and consequently moves the cam follower 14A1. This movement has the effect of disengaging the front tooth 20BA2 of the plunger cam 20B from the passage 21A of the rotary cam 20A. The front tooth 20BA2 of the plunger cam 20B is then received in an axial groove 12A25 of the front portion 12A. This groove 12A25 has an opening facing towards the rear in order to receive the front tooth 20BA2. The side walls of the opening converge from the rear towards the front so as to guide the front tooth 20BA2 into the groove 12A25 and so as to guide it in the circumferential direction C. This also makes it possible to realign the plunger cam 20B with the rotary cam 20A, and also the cam 18A of the selector device with the cam follower of the selected writing element in the event of untimely loss of alignment between them, e.g. as a result of rough handling or when the selector device 18 has been turned insufficiently to select a writing element. Naturally, the plunger cam 20B is configured so that the front teeth 20BA2 are in alignment with the grooves 12A25 when a writing element is selected by the selector device 18.

Figure 4B:
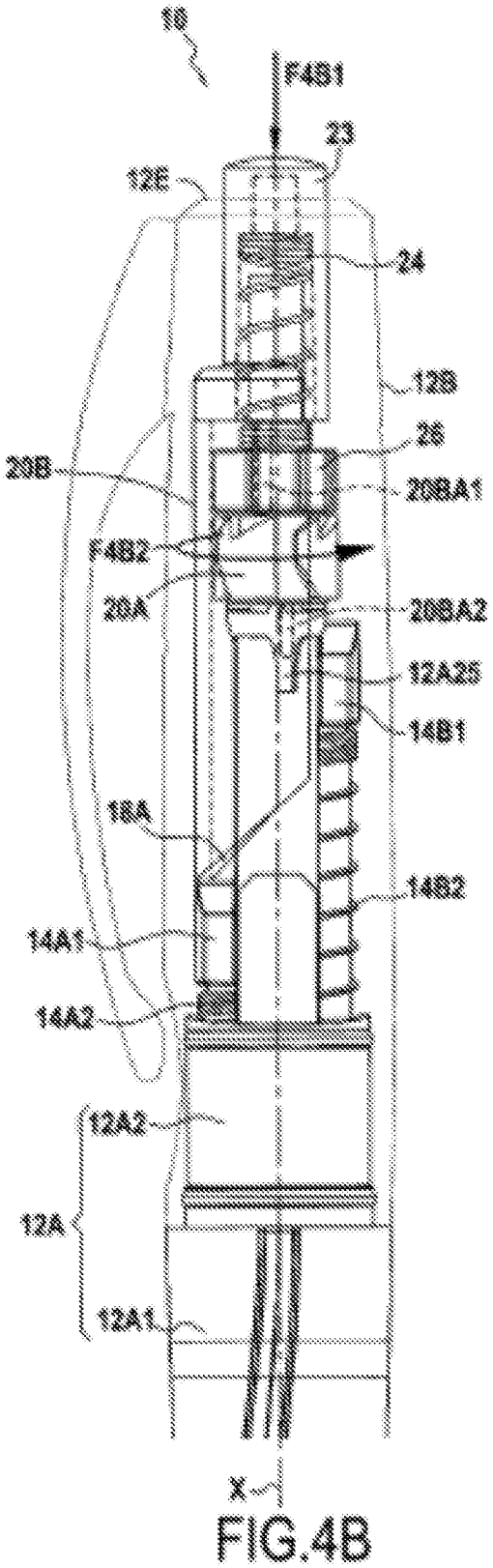
Figure 4C:
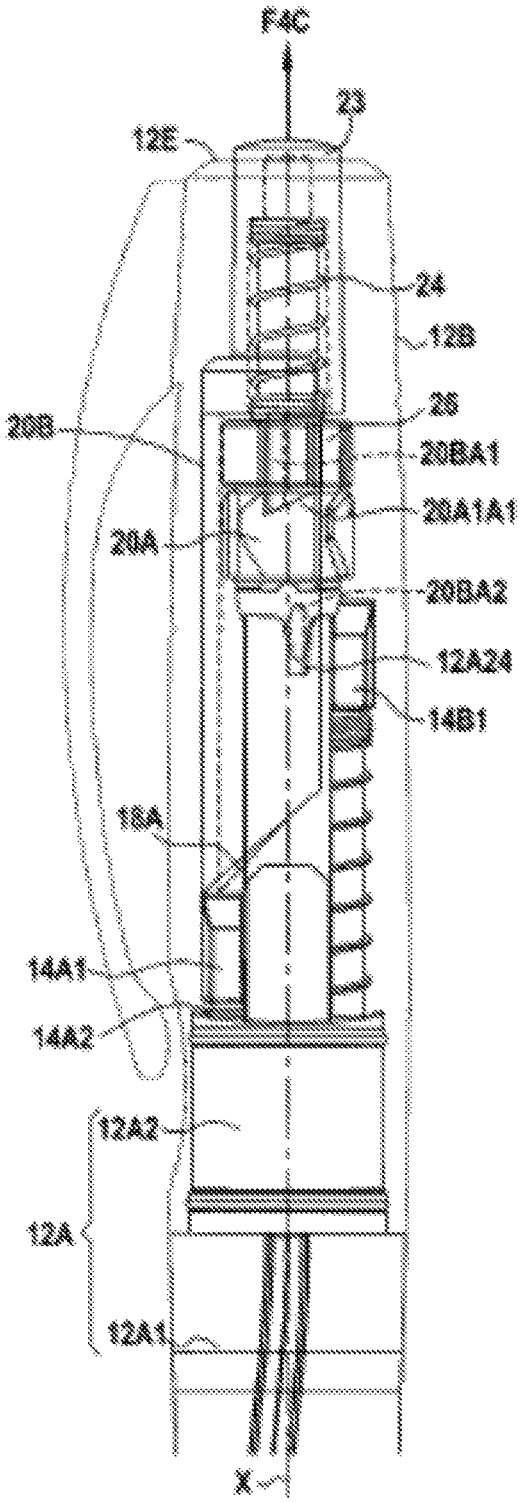

In FIG. 4B, the rear tooth 20BA1 of the plunger cam 20B is approaching the long tooth 20A1A1 of the rotary cam 20A. By continuing to press on the button 23 along arrow F4B1, the rear tooth 20BA1 of the plunger cam 20B is brought into co-operation with the sloping face of the long tooth 20A1A1 of the rotary cam 20A, thereby having the effect of turning the rotary cam 20A as shown by arrow F4B2 about the axial direction until the rear tooth 20BA1 comes into abutment in the circumferential direction against the face of the adjacent short tooth 20A1A2 that extends in the axial direction X. This position is shown in FIG. 4C. The button 23, and thus the cam 18A and the plunger cam 20B are at the end of their forward axial stroke. The user then releases axial pressure being exerted on the button 23, which returns rearwards as a result of the spring 14A2 of the writing element 14A relaxing and as a result of the spring 24 relaxing, as shown by arrow F4C, in order to reach the position shown in FIG. 4D.

Figure 4D:
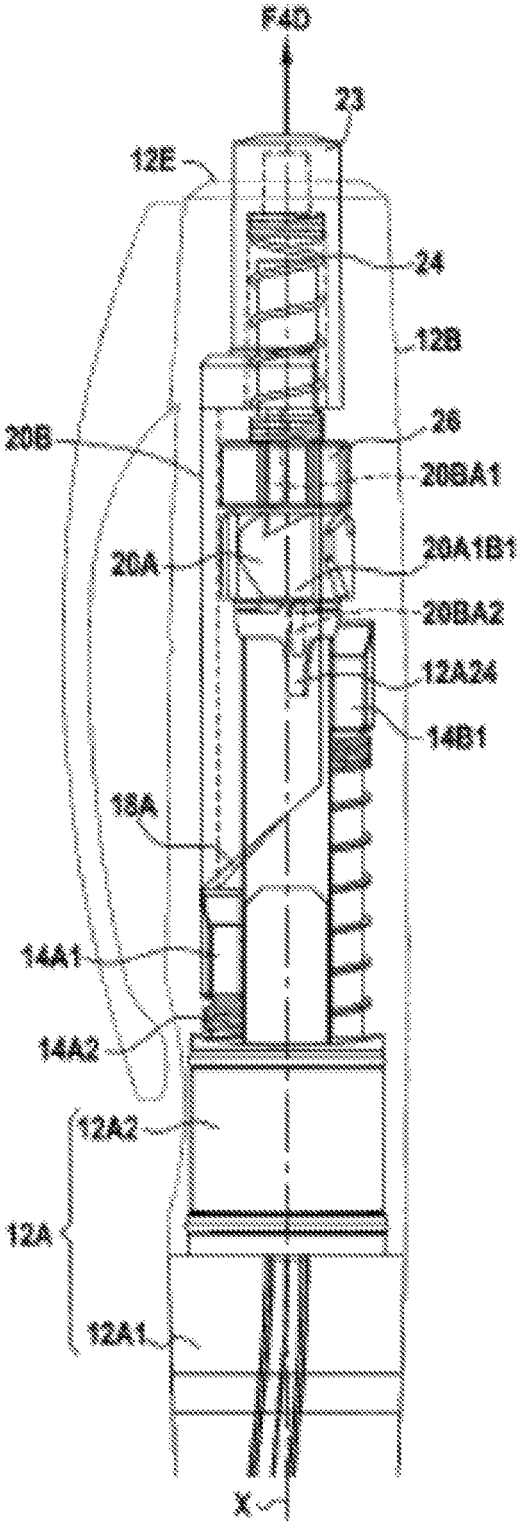

In FIG. 4D, the front tooth 20BA2 of the plunger cam 20B co-operates in abutment in the axial direction with the tooth 20A1B1 of the rotary cam 20A (since it has pivoted about the axial direction from the position shown in FIGS. 4A and 4B), thereby having the effect of coupling the rotary cam 20A in axial translation towards the rear with the plunger cam 20B. The spring 14A2 of the writing element 14A continues to act via the cam 18A to push the plunger cam 20B rearwards, as shown by arrow F4D, so as to reach the position shown in FIG. 4E.

Figure 4E:
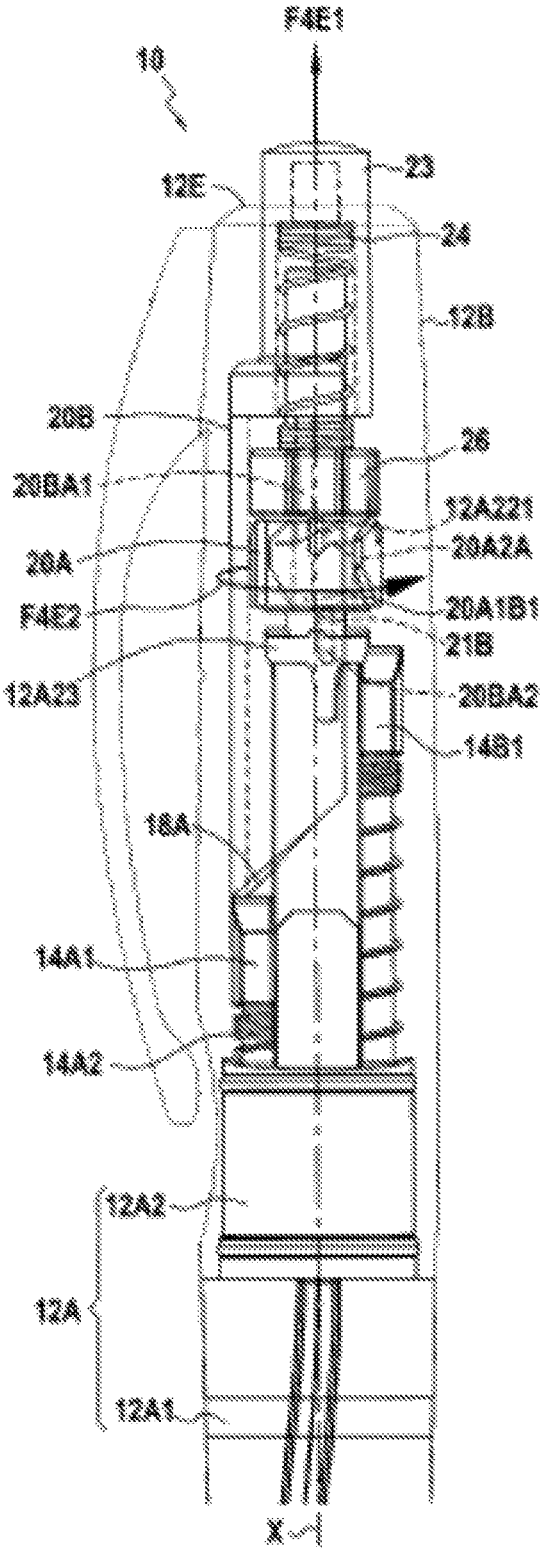

In FIG. 4E, the second series of teeth 20A2 of the rotary cam and one tooth 12A221 of the front portion are shown in dashed lines, whereas they are omitted from FIGS. 4A to 4D in order to simplify the views.

Since the rotary cam 20A is coupled in axial translation towards the rear with the plunger cam 20B, it is moved together with the plunger cam 20B towards the rear under the effect of the spring 14A2 of the writing element along arrow F4E1. The rotary cam 20A is thus spaced apart rearwards along the axial direction from the base 12A23 of the front portion 12A, while remaining engaged on the rod 12A22, such that the tooth 20A2A co-operates axially with the tooth 12A221 of the front portion 12A. In particular, the tooth 12A221 of the front portion 12A co-operates with the sloping face of the tooth 20A2A of the rotary cam 20A, thereby having the effect of turning the rotary cam 20A as shown by arrow F4E2, so as to bring the tooth 12A221 into alignment with the passage 21B. Once the tooth 12A221 and the passage 21B are in alignment, the spring 14A2 continues to push the rotary cam 20A rearwards so that the tooth 12A221 (i.e. in this example the rib 12A221) becomes engaged in the passage 21B (i.e. in this example the groove 21B). Thereafter, the spring 14A2 continues to push rearwards as shown by arrow F4E1 in order to reach the position shown in FIG. 4F.

Figure 4F:
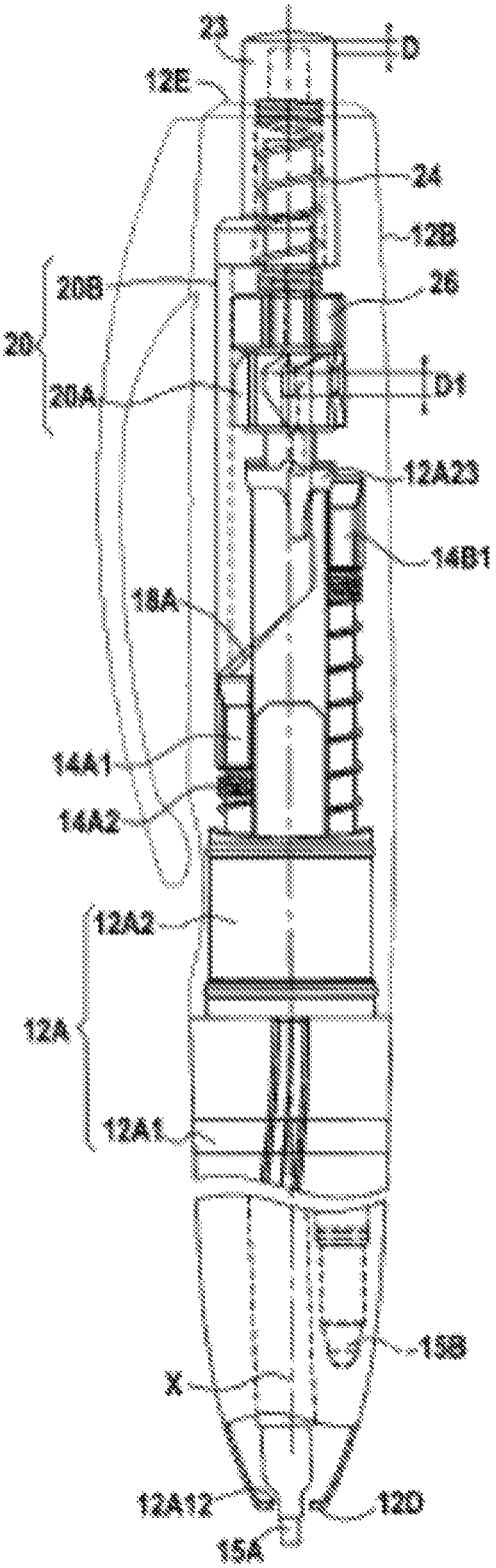

In FIG. 4F, rearward movement of the rotary cam 20A and of the plunger cam 20B is prevented by an axial abutment 12B2 (see FIG. 2, not shown in FIGS. 4E and 4F) that is provided in the rear portion 12B and that co-operates in abutment with the rotary cam 20A via the washer 26. Actuation of the ratchet mechanism 20 has thus terminated and the writing tip 15A of the writing element 14A is in the writing position. In this configuration where the writing element is in the writing position, the rotary cam 20A is rotatably coupled with the front portion 12A by means of the teeth 12A221 engaged in the passages 21B. Since the rotary cam 20A is spaced apart from the base 12A23 and since the teeth 12A221 are free to move axially in the passages 21B, the rotary cam 20A is free to move in translation along the axial direction X relative to the front portion 12A.

In this example, since the writing element 14A is a mechanical pencil, the lead 15A may either project from the head 14A3, as shown in FIG. 4F, or else it may be retracted inside the head 14A3. In order to cause the lead 15A to project from the head 14A3, or more generally in order to propel the lead 15A from the head 14A3, it suffices to actuate the button 23 over an axial stroke D that is less than the stroke D1 needed for actuating the ratchet mechanism 20 again. This has the effect of bringing the head 14A3 to bear against a shoulder 12Al2 inside the front portion 12A, thereby actuating the lead-propelling mechanism 14A4 and propelling the lead 15A. The ratchet mechanism 20 thus allows the lead to be propelled without itself being fully actuated. Naturally, if the writing tip of the writing element is a stationary tip, such as the ballpoint 15B, this action has no effect.

With reference to FIGS. 5A to 5E, there follows a description of causing a writing element to pass from the writing position to the retracted position by using the retraction device 20 (i.e. in this example the ratchet mechanism 20).

Figure 5A:
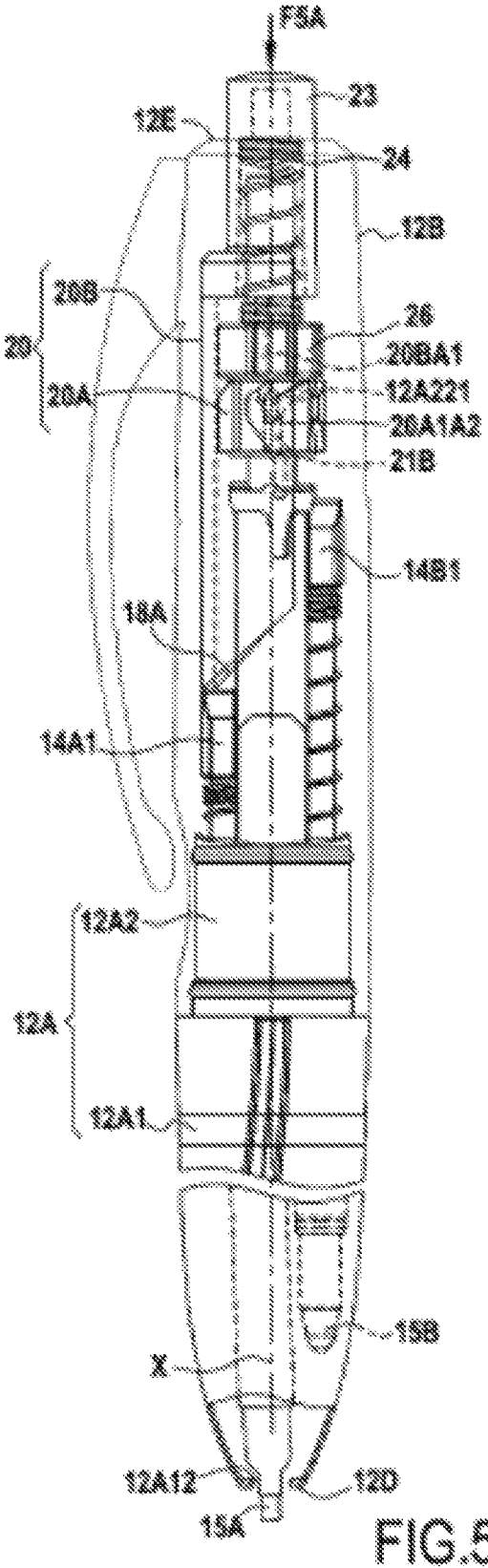
FIGS. 5A to 5E show the variant steps for causing the writing element to go from the writing position as shown in FIG. 4F to the retracted position by using the retraction device.

The position of FIG. 5A corresponds to the position of FIG. 4F. Pressing forwards in the axial direction X on the button 23 has the effect of actuating the ratchet mechanism 20, as shown by arrow FSA.

Figure 5B:
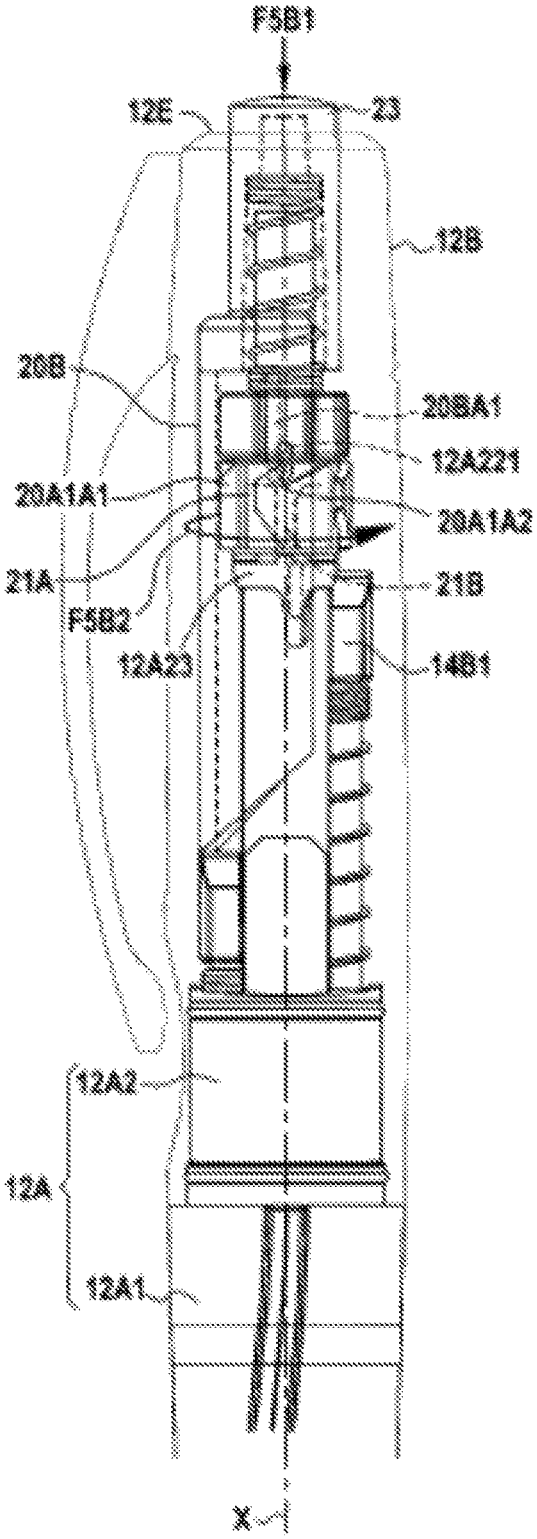

Under the action of the button 23, the rear tooth 20BA1 of the plunger cam 20B co-operates axially with the short tooth 20A1A2 of the rotary cam 20A, and more particularly with the sloping face of the short tooth 20A1A2. Since the rotary cam 20A is prevented from turning by the tooth 12A221, but free to move forwards in translation along the axial direction X, the plunger cam 20B pushes the rotary cam 20A forwards until the tooth 12A221 is disengaged from the passage 21B. This position is shown in FIG. 5B. The button 23 moving along the arrow F5A drives the spring 24, the washer 26, and the rotary cam 20A, with the rotary cam 20A remaining continuously pressed, via the washer 26, against the tooth 20BA2 under the action of the spring 24. Since the rotary cam 20A is prevented from turning by the tooth 12A221, but free to move forwards in the axial direction X, this set of parts moves axially together until the tooth 12A221 is disengaged from the passage 21B and the rotary cam 20A comes into abutment against the studs 12A23A. If pressure continues to be applied on the button 23, the rotary cam 20A disengages from the tooth 20BA2, while the rear tooth 20BA1 of the plunger cam 20B co-operates axially with the short tooth 20A1A2 of the rotary cam 20A, and more particularly with the sloping face of the short tooth 20A1A2.

Figure 5C:
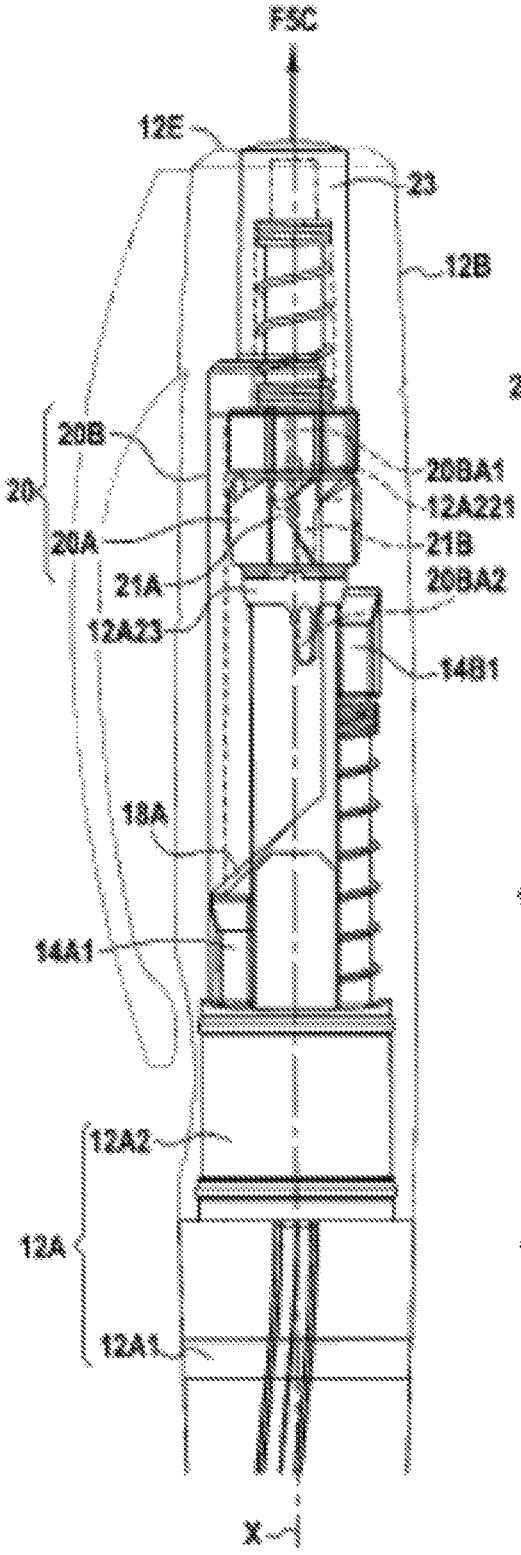

When the tooth 12A221 is disengaged from the passage 21B and pressure continues to be applied to the button 23 along arrow F5B1, the rotary cam 20A turns about the axial direction under the effect of pressure from the rear tooth 20BA1 of the plunger cam 20B against the sloping face of the short tooth 20Al2A of the rotary cam (see arrow F5B2). This effect is accentuated when the rotary cam 20A is prevented from moving in translation by co-operating axially in abutment against the base 12A23, as shown in FIG. 5B. The rotary cam 20B then turns until the rear tooth 20BA1 of the plunger cam 20B co-operates in the circumferential direction in abutment against the axially extending face of the adjacent long tooth 20A1A1 and is in alignment with the adjacent passage 21A. This turning also serves to take the tooth 12A221 of the front portion 12A out of alignment with the passage 21B, thereby causing the rotary cam 20A to be prevented from moving in translation along the axial direction X between the base 12A23 and the tooth 12A221, which now faces the shoulder formed by the tooth 20A21. This position is shown in FIG. 5C.

Figure 5D:
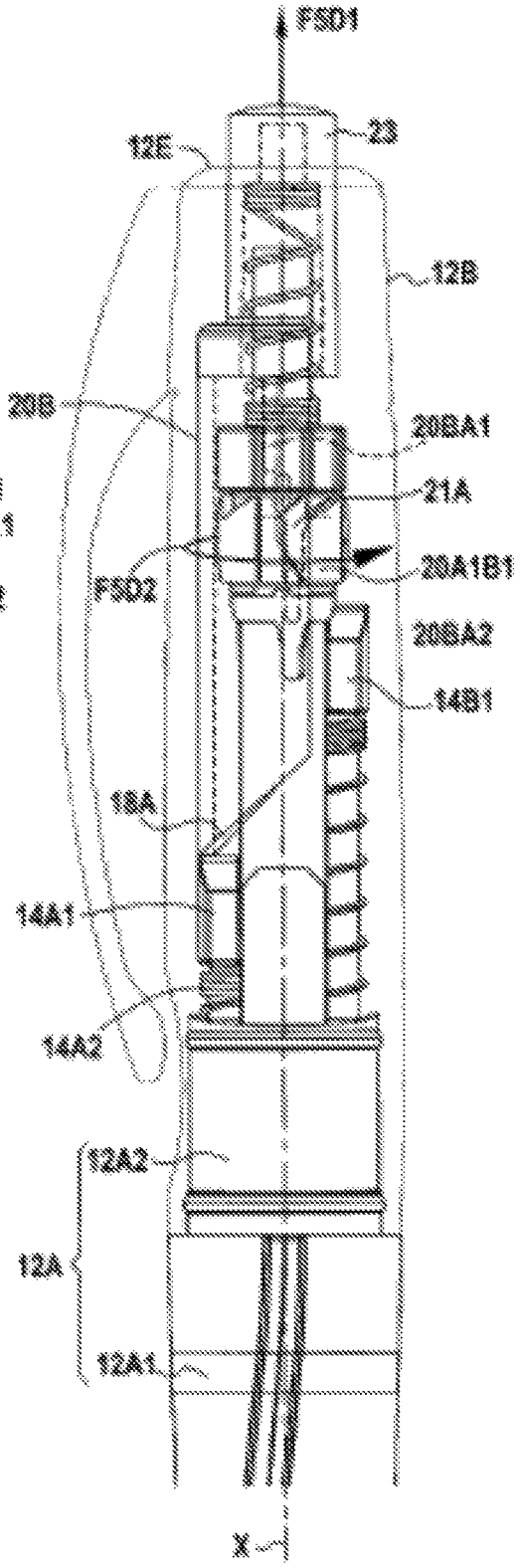

When the pressure applied to the button 23 is released, the button returns rearwards (see arrow F5C) under the effect of the spring 14A2 of the writing element and of the spring 24 (given that the rotary cam 20A is prevented from moving in translation), whereby the front tooth 20BA2 of the plunger cam 20B co-operates axially with the sloping face of the tooth 20A1B1 of the rotary cam 20A, thereby turning the rotary cam 20A. This configuration is shown in FIG. 5D.

Figure 5E:
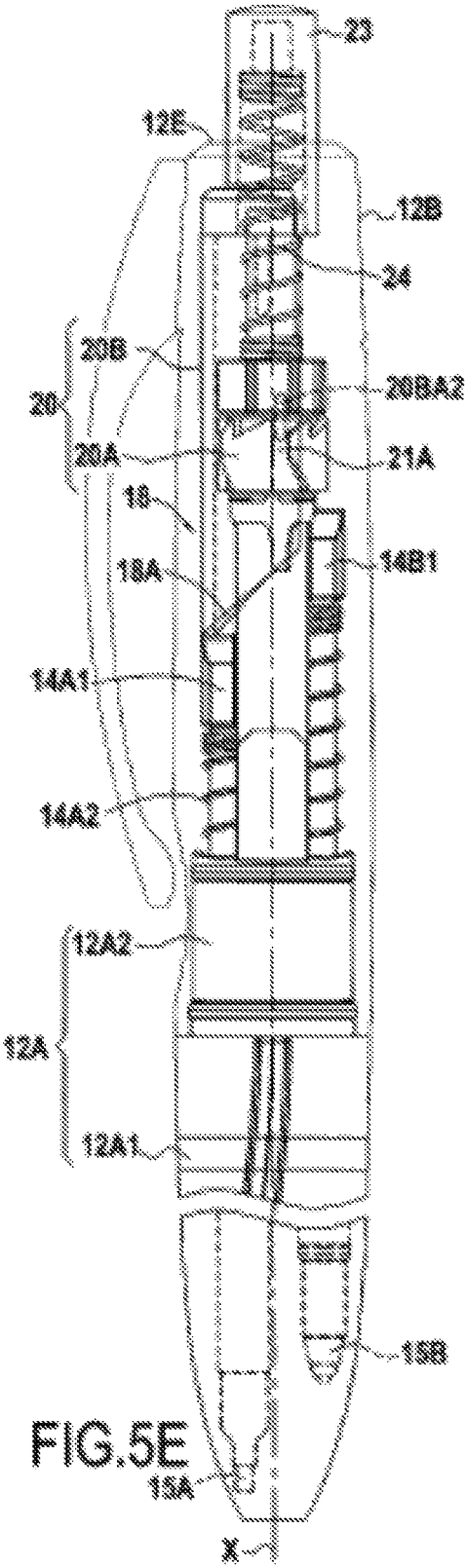

The rotary cam 20A turns under the effect of the tooth 20BA2 (see arrow F5D2) until the tooth 20BA2 co-operates in abutment in the circumferential direction with the axially extending face of the adjacent tooth 20A1B1 and is in alignment with the passage 21A. The plunger cam 20B can then move axially rearwards (see arrow F5D1) under the effect of the spring 14A2 of the writing element and of the spring 24 until the button 23 comes into abutment against the inside of the rear portion 12B of the body 12. The tooth 20BA2 of the plunger cam 20B remains engaged in the passage 21A of the rotary cam 20A, whereby the plunger cam 20B is rotatably coupled about the axial direction X with the rotary cam 20A. This configuration is shown in FIG. 5E and corresponds to the configuration of FIG. 4A. Actuation of the ratchet mechanism 20 has terminated and the writing element 14A is in the retracted position.

Figure 6A:
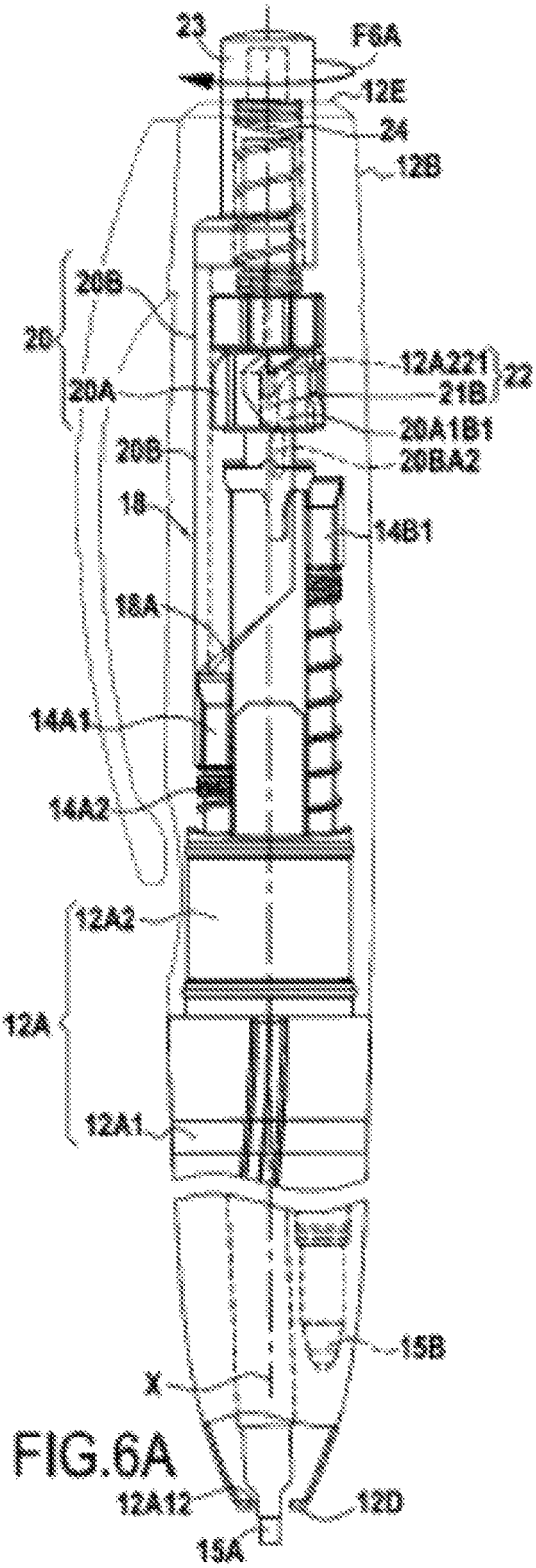
FIGS. 6A to 6C show the various steps for causing the writing element to pass from the writing position as shown in FIG. 4F to the retracted position, by means of the return device, when the selector device is actuated.
Figure 6B:
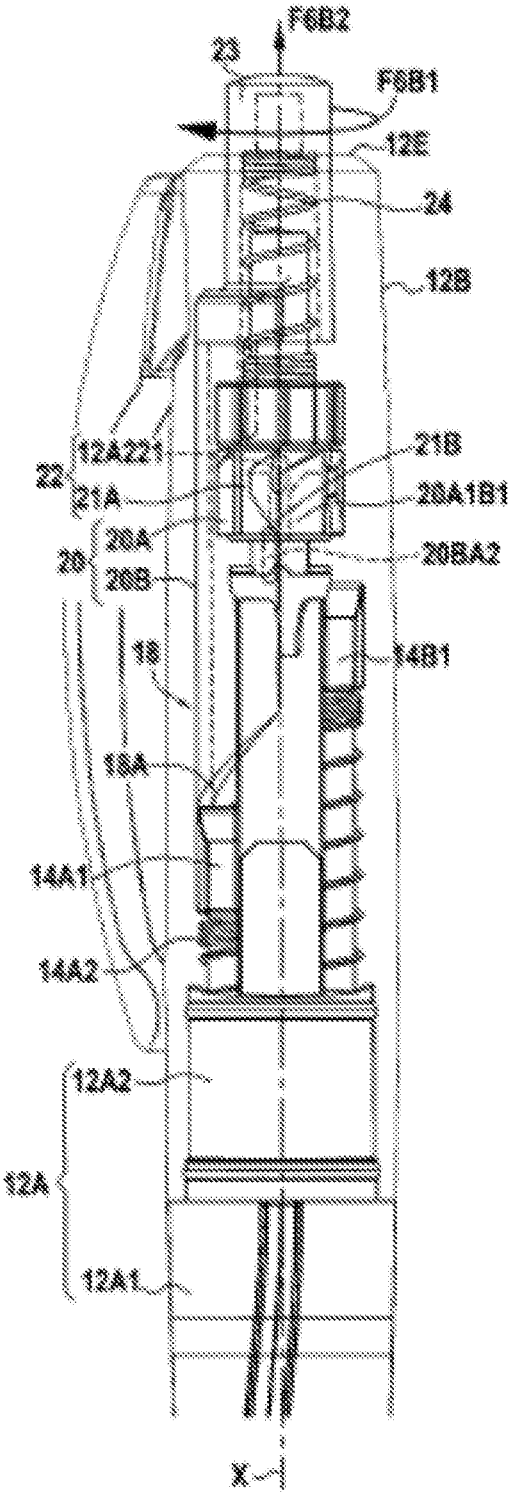
Figure 6C:
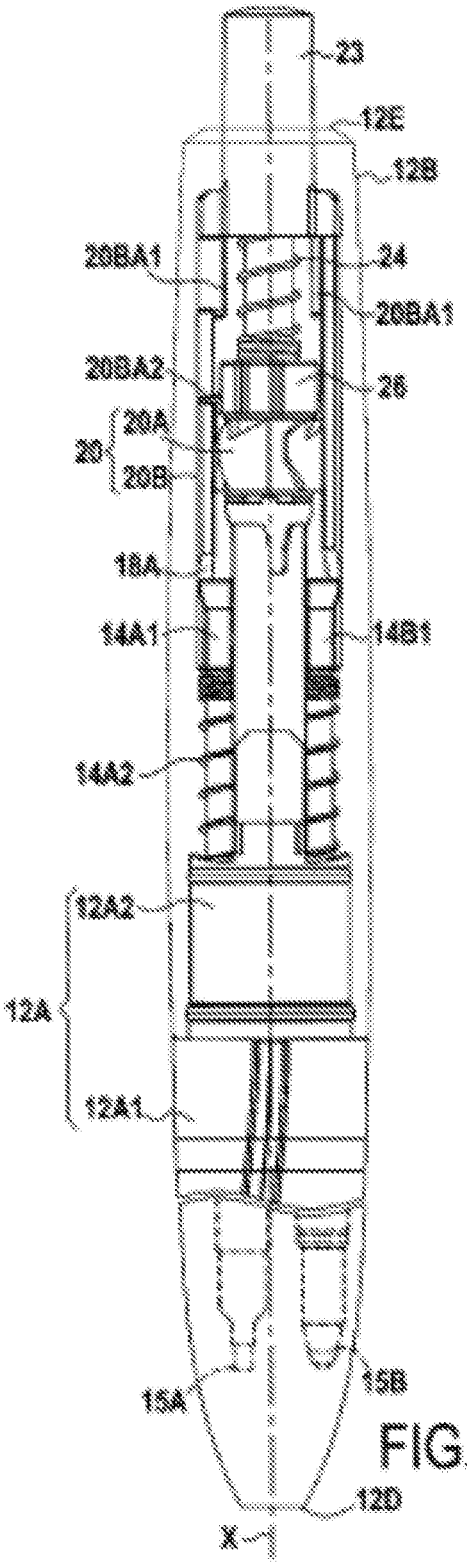

With reference to FIGS. 6A to 6C, there follows a description of passing a writing element from the writing position to the retracted position by using the return device 22.

The position of FIG. 6A corresponds to the position of FIG. 4F. The rear portion 12B is turned as shown by arrow F6A relative to the front portion 12A of the body 12 in order to actuate the selector device 18.

While turning, the rear portion 12B entrains both the cam 18A of the selector device 18 and also the plunger cam 20B of the retraction device 20. Since the rotary cam 20A is engaged with the tooth 12A221, it is rotatably coupled with the front portion 12A, and it is therefore not itself turned. During the turning movement of the rear portion 12B relative to the front portion 12A, the plunger cam 20B thus turns in the same manner relative to the rotary cam 20A. This has the effect of changing the position of the front tooth 20BA2 of the plunger cam 20B relative to the tooth 20A1B21 of the rotary cam 20A against which it presses. The front tooth 20BA2 thus slides from the face perpendicular to the axial direction X towards the face that slopes relative to the axial direction X of the tooth 20A1B1 with which it is co-operating. The spring 24 pushes the rotary cam 20A forwards relative to the plunger cam 20B, whereby the front tooth 20BA2 and the tooth 20A1B1 do indeed remain in contact with each other, while the rotary cam 20A becomes progressively disengaged from the tooth 12A221 of the front portion 12A. Furthermore, the cam 18A of the selector device 18 also turns relative to the writing elements, such that it begins to disengage from the element 14A, which begins to move rearwards under the effect of the spring 14A2. This configuration is shown in FIG. 6B.

By continuing the turning movement as shown by arrow F6B1, the front tooth 20BA2 of the plunger cam 20B continues its stroke along the sloping face of the tooth 20A1B1 of the rotary cam 20A until it engages in the adjacent passage 21A, while the spring 24 continues to push the rotary cam 20A forwards until it is totally disengaged from the tooth 12A221. It will naturally be understood that the axial movement of the rotary cam 20A relative to the plunger cam 20B and the front portion 12A follows the axial stroke of the front tooth 20BA2 on the sloping face of the tooth 20A1B1. The rotary cam 20A moves forwards until it comes into abutment against the base 12A23. When the rotary cam 20A is disengaged from the tooth 12A221, it is no longer rotatably coupled with the front portion 12A, while the engagement of the front tooth 20BA2 in the passage 21A couples the rotary cam 20A to turn with the plunger cam 20B. The rotary cam 20A and the plunger cam 20B turning together serves to bring the tooth 12A221 of the front portion 12A out of alignment with the passage 21B, such that the tooth 12A221 co-operates axially with the tooth 20A2A and prevents the rotary cam 20A from moving axially in translation towards the rear. Under the effect of the spring 14A2, the plunger cam 20B moves rearwards relative to the rotary cam 20A along arrow F6B2, thereby bringing the writing element 14A into the retracted position. This configuration is shown in FIG. 6C. Thus by actuating the selector device 18 while a writing element is selected, the return device 22, which in this example comprises the teeth 12A221 and the passages 21B, serves to cause the rotary cam 20A to turn relative to the plunger cam 20B so as to release the plunger cam 20B relative to the rotary cam 20A in the axial direction X, and brings the writing element into the retracted position. It should be observed in this example that it is also possible to bring the writing element into the retracted position by actuating the return device 22 so that it turns in the direction opposite to the arrows F6A and F6B1.

Although the present disclosure is described with reference to specific embodiments, it is clear that modifications and changes may be carried out on those examples without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

The invention claimed is:

1. A multifunction writing instrument comprising a body that extends along an axial direction and houses two or more writing elements, each writing element including a writing tip, a selector device configured to select one writing element from the two or more writing elements, a retraction device configured to move a selected writing element between a writing position in which the writing tip of the selected writing element projects from the body and a retracted position in which the writing tip of the selected writing element is retracted, and a return device configured to bring one of the writing elements that is in the writing position back to the retracted position when the selector device is activated so that a different writing element of the two or more writing elements is able to be moved to the writing position, wherein the body comprises a front portion and a rear portion, the front portion and the rear portion being rotatably movable relative to each other about the axial direction, the selector device comprising a cam rotatably coupled with the rear portion and configured to co-operate with the writing elements while the writing elements are rotatably coupled with the front portion, the retraction device comprising a ratchet mechanism comprising a rotary cam and a plunger cam, the plunger cam being rotatably coupled with the rear portion, the rotary cam being rotatably coupled with the front portion when a writing element is in the writing position, while the rotary cam is free to rotate relative to the front portion when all of the writing elements are in the retracted position, whereby the rotary cam turns so as to release the plunger cam in the axial direction relative to the rotary cam when the selector device is activated while a writing element is in the writing position.

2. A multifunction writing instrument according to claim 1, wherein the front portion presents an axially extending rod, the rod including at least one axial groove or at least one axial rib, the rotary cam being engaged around the rod and presenting respectively at least one axial rib or at least one axial groove, the axial rib and the axial groove being engaged with each other when a writing element is in the writing position, and being disengaged from each other when all of the writing elements are in the retracted position.

3. A multifunction writing instrument according to claim 2, wherein the cam of the selector device and the plunger cam of the ratchet mechanism are formed by a single part.

4. A multifunction writing instrument according to claim 1, wherein the cam of the selector device and the plunger cam of the ratchet mechanism are formed by a single part.

5. A multifunction writing instrument according to claim 4, wherein the plunger cam includes an annular portion, the rotary cam being arranged radially inside the annular portion.

6. A multifunction writing instrument according to claim 1, wherein the plunger cam includes an annular portion, the rotary cam being arranged radially inside the annular portion.

7. A multifunction writing instrument according to claim 6, wherein the rotary cam is prevented from moving in the axial direction relative to the front portion when all of the writing elements are in the retracted position, while the rotary cam is movable along the axial direction relative to the front portion when a writing element is in the writing position.

8. A multifunction writing instrument according to claim 1, wherein the rotary cam is prevented from moving in the axial direction relative to the front portion when all of the writing elements are in the retracted position, while the rotary cam is movable along the axial direction relative to the front portion when a writing element is in the writing position.

9. A multifunction writing instrument according to claim 8, wherein the rotary cam is rotatably coupled with the plunger cam when all of the writing elements are in the retracted position.

10. A multifunction writing instrument according to claim 1, wherein the rotary cam is rotatably coupled with the plunger cam when all of the writing elements are in the retracted position.

11. A multifunction writing instrument according to claim 10, wherein the cam of the selector device is configured to co-operate with cam followers of the writing elements, each cam follower being received to slide axially in an axial guide of the front portion.

12. A multifunction writing instrument according to claim 1, wherein the cam of the selector device is configured to co-operate with cam followers of the writing elements, each cam follower being received to slide axially in an axial guide of the front portion.

13. A multifunction writing instrument according to claim 2, wherein at least one writing element is a mechanical pencil, the retraction device being usable to propel a lead of the mechanical pencil when the mechanical pencil is in the writing position.

14. A multifunction writing instrument according to claim 13, wherein the mechanical pencil presents a writing head that is configured to carry the lead, said lead forming a writing tip, the writing head projecting from the body when the mechanical pencil is selected by means of the selector device.

15. A multifunction writing instrument according to claim 1, wherein at least one writing element is a mechanical pencil, the retraction device being usable to propel a lead of the mechanical pencil when the mechanical pencil is in the writing position.

16. A multifunction writing instrument according to claim 15, wherein the mechanical pencil presents a writing head that is configured to carry the lead, said lead forming a writing tip, the writing head projecting from the body when the mechanical pencil is selected by means of the selector device.

17. A multifunction writing instrument comprising a body that extends along an axial direction and houses two or more writing elements, each writing element including a writing tip, the body further houses a selector device configured to select one writing element, a retraction device configured to move a selected writing element between a writing position in which the writing tip of the selected writing element projects from the body and a retracted position in which the writing tip of the selected writing element is retracted, and a return device that is coupled with the selector device at least while a writing element is in the writing position such that the return device is able to bring the writing element that is in the writing position back to the retracted position when the selector device is activated so that a different writing element of the two or more writing elements is able to be moved to the writing position, wherein the body comprises a front portion and a rear portion, the front portion and the rear portion being rotatably movable relative to each other about the axial direction, the selector device comprising a cam rotatably coupled with the rear portion and configured to co-operate with the writing elements while the writing elements are rotatably coupled with the front portion, the retraction device comprising a ratchet mechanism comprising a rotary cam and a plunger cam, the plunger cam being rotatably coupled with the rear portion, the rotary cam being rotatably coupled with the front portion when a writing element is in the writing position, while the rotary cam is free to rotate relative to the front portion when all of the writing elements are in the retracted position, whereby the rotary cam turns so as to release the plunger cam in the axial direction relative to the rotary cam when the selector device is activated while a writing element is in the writing position.

18. The multifunction writing instrument of claim 17, wherein at least one writing element is a mechanical pencil, the retraction device being usable to propel a lead of the mechanical pencil when the mechanical pencil is in the writing position.

* * * * *